US011976447B2

(12) United States Patent
Bai et al.

(10) Patent No.: US 11,976,447 B2
(45) Date of Patent: May 7, 2024

(54) COUNTERTOP INSTALLATION ASSEMBLY AND FAUCET

(71) Applicant: Xiamen Lota International Co., Ltd., Fujian (CN)

(72) Inventors: Shuanglin Bai, Fujian (CN); Liming Ye, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 169 days.

(21) Appl. No.: 17/858,254

(22) Filed: Jul. 6, 2022

(65) Prior Publication Data

US 2024/0011261 A1 Jan. 11, 2024

(51) Int. Cl.
*E03C 1/04* (2006.01)

(52) U.S. Cl.
CPC ..... *E03C 1/0402* (2013.01)

(58) Field of Classification Search
CPC ..... E03C 1/0402
See application file for complete search history.

(56) References Cited

U.S. PATENT DOCUMENTS 8,899,259 B2 * 12/2014 Jonte ..... E03C 1/0402 285/193
2017/0051479 A1 * 2/2017 Bomatter ..... E03C 1/0401
2022/0112699 A1 * 4/2022 Luo ..... E03C 1/0402

FOREIGN PATENT DOCUMENTS

CN 107268726 A 10/2017
CN 215367579 U 12/2021

* cited by examiner

*Primary Examiner* — Christine J Skubinna
(74) *Attorney, Agent, or Firm* — Cooper Legal Group, LLC

(57) ABSTRACT

A countertop installation assembly comprises an installation seat, a driving member, and a fastening assembly. The installation seat is positioned in the installation hole and is configured to extend to below the countertop. The installation seat comprises a receiving cavity extending along a longitudinal direction. The driving member is rotatably disposed in the installation seat. The fastening assembly is operatively coupled to the driving member, and the fastening assembly is located below the countertop and moves up and down in the receiving cavity. The driving member is rotated from above the countertop to drive the fastening assembly to move up and down in the receiving cavity so as to enable the fastening assembly to be clamped to or separated from a lower side of the countertop. The fastening assembly is driven by the driving member to move between a retracted position and an extended position.

7 Claims, 7 Drawing Sheets

COUNTERTOP INSTALLATION ASSEMBLY AND FAUCET

FIELD OF THE DISCLOSURE

The present disclosure relates to a countertop installation assembly and a faucet.

BACKGROUND OF THE DISCLOSURE

At present, most of the faucets fixed on a counter basin or a sink are installed from below the counter basin or the sink, which is hereinafter referred to as an under-counter installation. However, the under-counter installation has the following disadvantages. 1. Installation personnel need to drill into a narrow space below the counter basin or the sink for installation, so the installation difficulty is increased. 2. The light is insufficient, and holding a light source by hand or manual operation in the dark is needed. 3. A lower space of the counter basin or the sink is also disposed with a ceramic basin, a water tank, a pipeline, and the like which obstruct the view and the operation space, so that the use or the continuous use of tools such as a wrench and the like is often limited, and the operation time is greatly prolonged. 4. When installation personnel move below the counter basin or the sink, they must perform disassembly and assembly work in a leaning and looking up posture, and this posture leads to tiring easily. Fatigue will increase significantly if the pipe layout below the counter basin or the sink prevents the normal use of the tool.

Chinese patent number 201710674815.1 discloses a countertop installation device for a faucet and a countertop installation method of the faucet. Although it is installed on a countertop, the assembly process is more complicated, there are many parts, and the operation is still very difficult.

BRIEF SUMMARY OF THE DISCLOSURE

The present disclosure provides a countertop installation assembly and a faucet to solve the deficiencies in the background. A first technical solution of the present disclosure is as follows.

A countertop installation assembly, configured for being installed on a countertop having an installation hole, comprises an installation seat, a driving member, and a fastening assembly. The installation seat is configured to be positioned in the installation hole and is configured to extend to below the countertop, and the installation seat comprises a receiving cavity extending along a longitudinal direction of the installation seat. The driving member is rotatably disposed in the installation seat. The fastening assembly is operatively coupled to the driving member, and the fastening assembly is located below the countertop and is configured to move up and down in the receiving cavity. The driving member is configured to be rotated from above the countertop to drive the fastening assembly to move up and down in the receiving cavity so as to enable the fastening assembly to be clamped to or separated from a lower side of the countertop. A side wall of the receiving cavity comprises a position-providing opening. The fastening assembly is driven by the driving member to be configured to move between a retracted position and an extended position. When the fastening assembly is at the retracted position, the fastening assembly extends into the position-providing opening, and an outer side surface of the fastening assembly is substantially aligned with an outer peripheral surface of the installation seat. When the fastening assembly is at the extended position, the fastening assembly is moved out of the position-providing opening, the outer side surface of the fastening assembly extends out of the outer peripheral surface of the installation seat, and the fastening assembly is movable along the receiving cavity.

In a preferred embodiment, the driving member is a threaded rod, and the threaded rod passes through the receiving cavity along the longitudinal direction of the installation seat and is configured to rotate relative to the receiving cavity. The fastening assembly comprises a fastening member and a nut. The fastening member comprises a transverse protruding portion configured to move into the position-providing opening and a longitudinal protruding portion configured to be clamped to the lower side of the countertop. The transverse protruding portion comprises an inclined cavity, and the nut is screwed on the threaded rod and is located in the inclined cavity.

In a preferred embodiment, a top end of the inclined cavity is adjacent to a central axis of the installation seat, and a bottom end of the inclined cavity is separated from the central axis of the installation seat. When the nut is located at the bottom end of the inclined cavity, the transverse protruding portion extends into the position-providing opening, and the longitudinal protruding portion is located in the receiving cavity. When the nut is located at the top end of the inclined cavity, the transverse protruding portion moves out of the position-providing opening, and the longitudinal protruding portion extends out of the receiving cavity.

In a preferred embodiment, a top end and a bottom end of the nut respectively comprise an inclined surface configured to cooperate with the inclined cavity.

In a preferred embodiment, an inside of the installation seat comprises an upper transverse partition, a longitudinal partition, and a lower transverse partition, and the upper transverse partition, the longitudinal partition, and the lower transverse partition are connected together in sequence to define the receiving cavity. The upper transverse partition comprises an upper through hole, and the lower transverse partition comprises a lower through hole. A top end of the threaded rod comprises a head that abuts the upper transverse partition, and a bottom end of the threaded rod passes through the upper through hole and the lower through hole in sequence. The nut is located between the upper through hole and the lower through hole.

In a preferred embodiment, a top end of the installation seat comprises a position-limiting protrusion, and the position-limiting protrusion is configured to abut a top end surface of the installation hole.

A second technical solution of the present disclosure is as follows.

A faucet comprises the countertop installation assembly.

Compared with the existing techniques, the technical solution has the following advantages.

1. The countertop installation assembly is simple in structure, has fewer parts, and is extremely convenient to install. When the countertop installation assembly is installed, the fastening assembly can be driven to move upwards in the receiving cavity until the fastening assembly is locked on the lower side of the countertop by only rotating the driving member in the forward direction above the countertop. When the countertop installation assembly needs to be disassembled, the driving member is rotated in the reversing direction from above the countertop, so that the fastening assembly moves downward to be separated from the countertop. The mounting and dismounting processes can be realized only by rotating the driving member and can be finished only above the countertop, so that the mounting and dismounting steps are greatly simplified, and the mounting cost is reduced.

2. When the fastening assembly extends into the position-providing opening, the outer side surface of the fastening assembly is generally aligned with the outer peripheral surface of the installation seat, and the fastening assembly is at the retracted position. That is, the transverse dimension of the installation seat is not increased, the installation seat can freely pass through the installation hole from above the countertop and extend below of the countertop, and the fastening assembly cannot move along the receiving cavity. When the fastening assembly is at the extended position, the fastening assembly moves out of the position-providing opening, and the outer side surface of the fastening assembly extends out of the outer peripheral surface of the installation seat and can move along the receiving cavity so as to ensure that the fastening assembly can be locked and matched with the countertop.
3. Since the nut is screwed on the threaded rod and is located in the inclined cavity, the nut can drive the fastening member to transversely move between a moving-in position, at which the fastening member moves into the position-providing opening, and a moving-out position, at which the fastening member moves out of the position-providing opening, through driving of the nut when the threaded rod is rotated.
4. The top end and the bottom end of the nut respectively comprise an inclined surface configured to cooperate with the inclined cavity. A cavity wall of the inclined cavity can move along the inclined surfaces of the nut, which can guarantee better transmission effect.

DETAILED DESCRIPTION OF THE EMBODIMENTS

Figure 1:
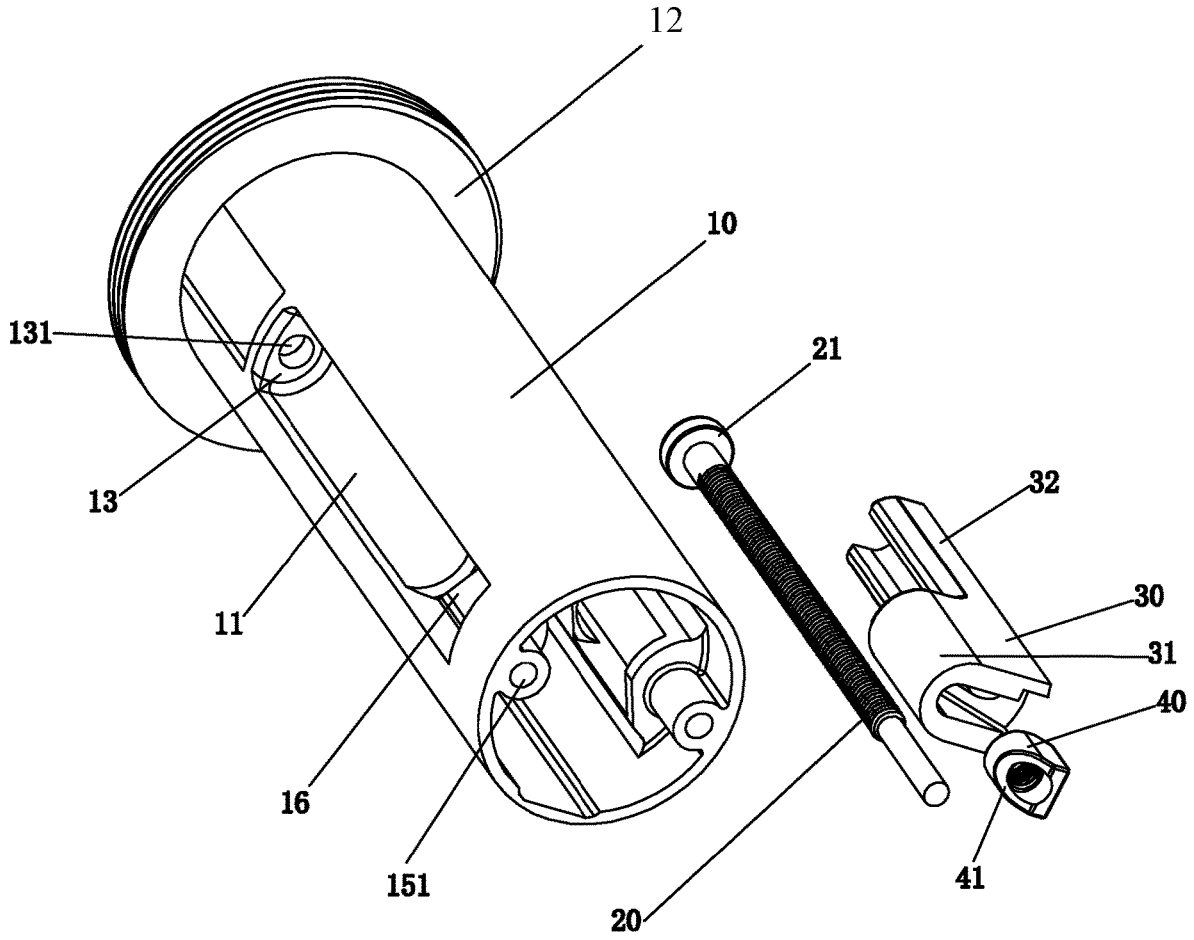
FIG. 1 illustrates an exploded view of a countertop installation assembly of a preferred embodiment in the present disclosure.

The present disclosure will be further described below in combination with the accompanying drawings and embodiments.

Unless otherwise clearly defined in the claims, description, and the above-mentioned drawings of the disclosure, the terms "first", "second", "third", and so on are used to distinguish different objects, not used to describe a specific order.

Unless otherwise clearly defined in the claims, description, and the above-mentioned drawings of the disclosure, for location words, such as the use of the terms "center", "transverse", "perpendicular", "horizontal", "vertical", "top", "bottom", "inner", "outer", "upper", "lower", "front", "rear", "left", "right", "clockwise", "counterclockwise", and other indication orientations or positional relationships are based on the orientations and positional relationships shown in the drawings, are provided to facilitate the description of the disclosure and simplify the description, and are not intended to indicate or imply that the indicated device or element must have a specific orientation or be constructed and operated in a specific orientation. Such words should not be understood as limiting the specific protection scope of the disclosure.

In the claims, the description, and the drawings of the present disclosure, unless otherwise explicitly defined, if the term "fixed connection" or "fixedly connected" is used, it should be understood in a broad sense. That is, any connection method without displacement relationship and relative rotation relationship between the two, that is, including non-removable fixed connection, removably fixed connection, connected as a whole, and fixed connection through other devices or components.

In the claims, the description, and the drawings of the present disclosure, the terms "including", "having", and their variations are intended to mean "including but not limited to".

Referring to FIGS. 1-6, a preferred embodiment of a countertop installation assembly is provided, the countertop installation assembly is suitable for being installed on a countertop, and the countertop comprises an installation hole.

The countertop installation assembly comprises an installation seat 10, a driving member, and a fastening assembly.

The installation seat 10 is configured to be positioned in the installation hole and is configured to extend to below the countertop, and the installation seat 10 comprises a receiving cavity 11 extending along a longitudinal direction of the installation seat 10.

Figure 4:
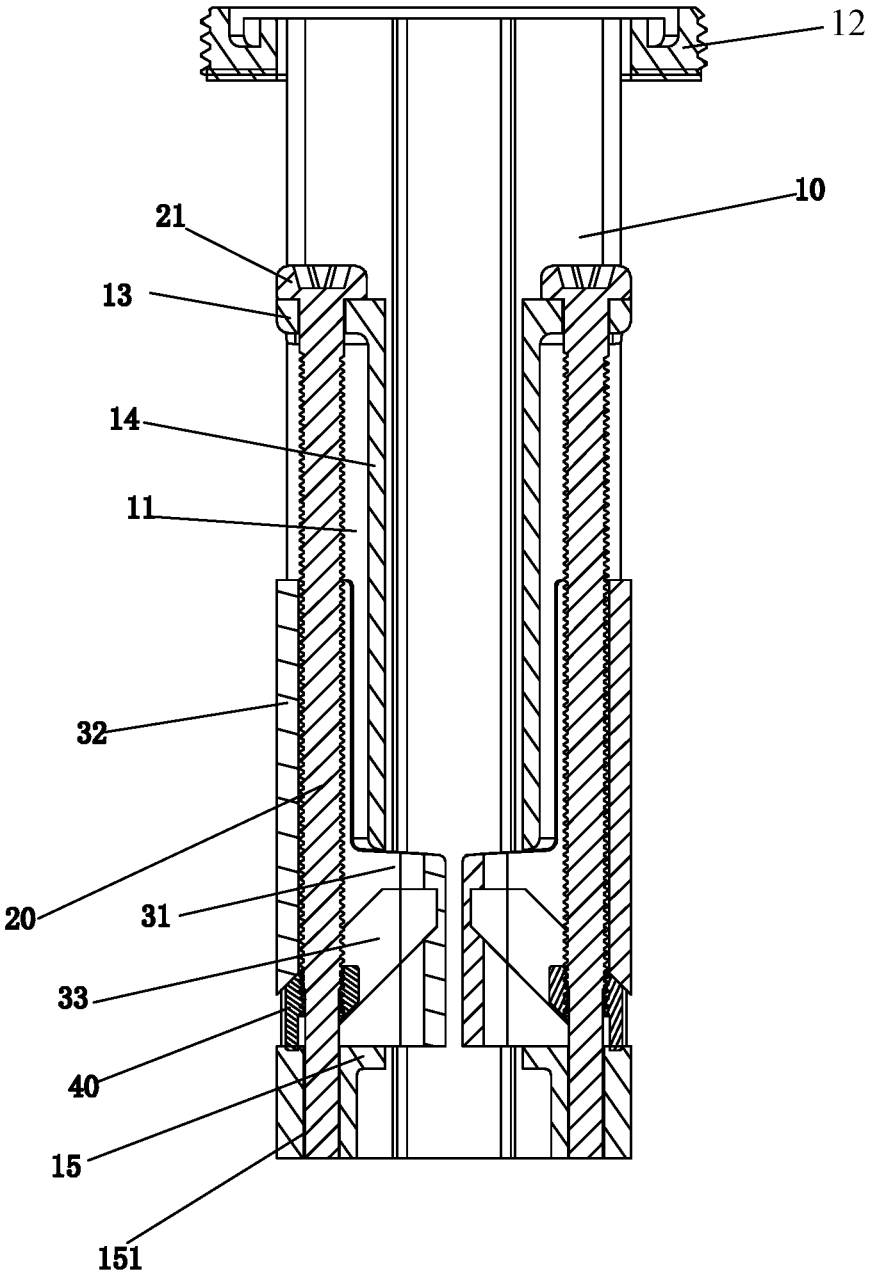
FIG. 4 illustrates a cross-sectional view of the countertop installation assembly of a preferred embodiment in the present disclosure, when the fastening assembly extends into the position-providing opening.

In this embodiment, a top end of the installation seat 10 comprises a position-limiting protrusion 12, and the position-limiting protrusion 12 is configured to abut a top end surface of the installation hole. Referring to FIG. 4, the installation seat 10 is a hollow cylinder, an inside of the installation seat 10 comprises an upper transverse partition 13, a longitudinal partition 14, and a lower transverse partition 15, and the upper transverse partition 13, the longitudinal partition 14, and the lower transverse partition 15 are connected together in sequence to define the receiving cavity 11, so that the receiving cavity 11 11 has a lateral opening. The upper transverse partition 13 comprises an upper through hole 131, and the lower transverse partition 15 comprises a lower through hole 151.

In this embodiment, referring to FIG. 1, a sidewall of a bottom end of the receiving cavity 11 comprises a position-providing opening 16.

The driving member is rotatably disposed in the installation seat 10.

In this embodiment, the driving member is a threaded rod 20, and the threaded rod 20 passes through the receiving cavity 11 along the longitudinal direction of the installation seat 10 and can rotate relative to the receiving cavity 11. Specifically, a top end of the threaded rod 20 comprises a head 21, and the head 21 abuts the upper transverse partition 13. A bottom end of the threaded rod 20 passes through the upper through hole 131 and the lower through hole 151 in sequence, and the upper through hole 131 corresponds to a top opening of the installation seat 10. A periphery of a middle portion of the threaded rod 20 comprises external threads, and a periphery of an upper portion and a periphery of a lower portion of the threaded rod 20 having smooth surfaces are respectively coupled to the upper through hole 131 and the lower through hole 151 in a rotatable connection. That is, the threaded rod 20 is rotatably coupled to the installation seat 10 through the rotatable connection with the upper through hole 131 and the lower through hole 151, and a screwdriver can be inserted into the installation seat 10 from the top opening of the installation seat 10 to engage with the head 21 to rotate the threaded rod 20.

The fastening assembly is operatively coupled to the driving member, and the fastening assembly is located below the countertop and can move up and down in the receiving cavity 11. The driving member is rotated from above the countertop to drive the fastening assembly to move up and down in the receiving cavity 11 so that the fastening assembly can be clamped to or separated from a lower side of the countertop.

Figure 2:
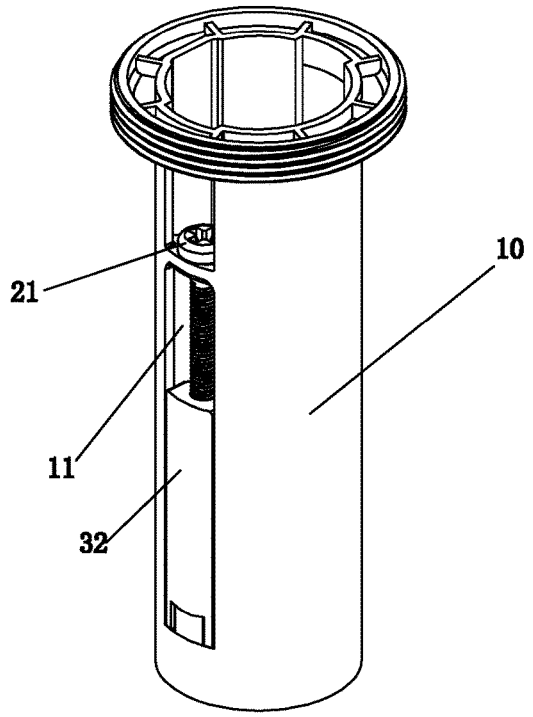
FIG. 2 illustrates a perspective view of the countertop installation assembly of a preferred embodiment in the present disclosure, when a fastening assembly extends into a position-providing opening.
Figure 3:
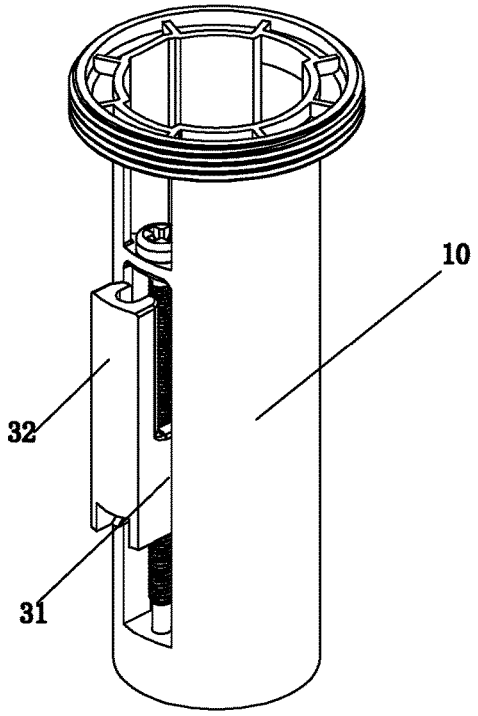
FIG. 3 illustrates a perspective view of the countertop installation assembly of a preferred embodiment in the present disclosure, when the fastening assembly moves along a receiving cavity.

In this embodiment, the fastening assembly is driven by the driving member to move between a retracted position and an extended position. When the fastening assembly is at the retracted position, the fastening assembly extends into the position-providing opening 16, and an outer side surface of the fastening assembly is substantially aligned with an outer peripheral surface of the installation seat 10. Referring to FIG. 2, the fastening assembly is in an initial state. That is, a transverse dimension of the installation seat 10 is not increased, and the installation seat 10 can freely pass through the installation hole from above the countertop to extend to below of the countertop. At this time, the fastening assembly cannot move along the receiving cavity 11. When the fastening assembly is at the extended position, the fastening assembly is moved out of the position-providing opening 16, the outer side surface of the fastening assembly extends out of the outer peripheral surface of the installation seat 10, the fastening assembly is movable along the receiving cavity 11, and a top end of the fastening assembly faces the countertop to ensure that the fastening assembly can be in locking engagement with the countertop.

Specifically, the fastening assembly comprises a fastening member 30 and a nut 40. The fastening member 30 comprises a transverse protruding portion 31 configured to move into the position-providing opening 16 and a longitudinal protruding portion 32 configured to be clamped to the lower side of the countertop. That is, the fastening member 30 is substantially L-shaped; the transverse protruding portion 31 comprises an inclined cavity 33, and the nut 40 is screwed on the threaded rod 20 and is located in the inclined cavity 33.

Figure 5:
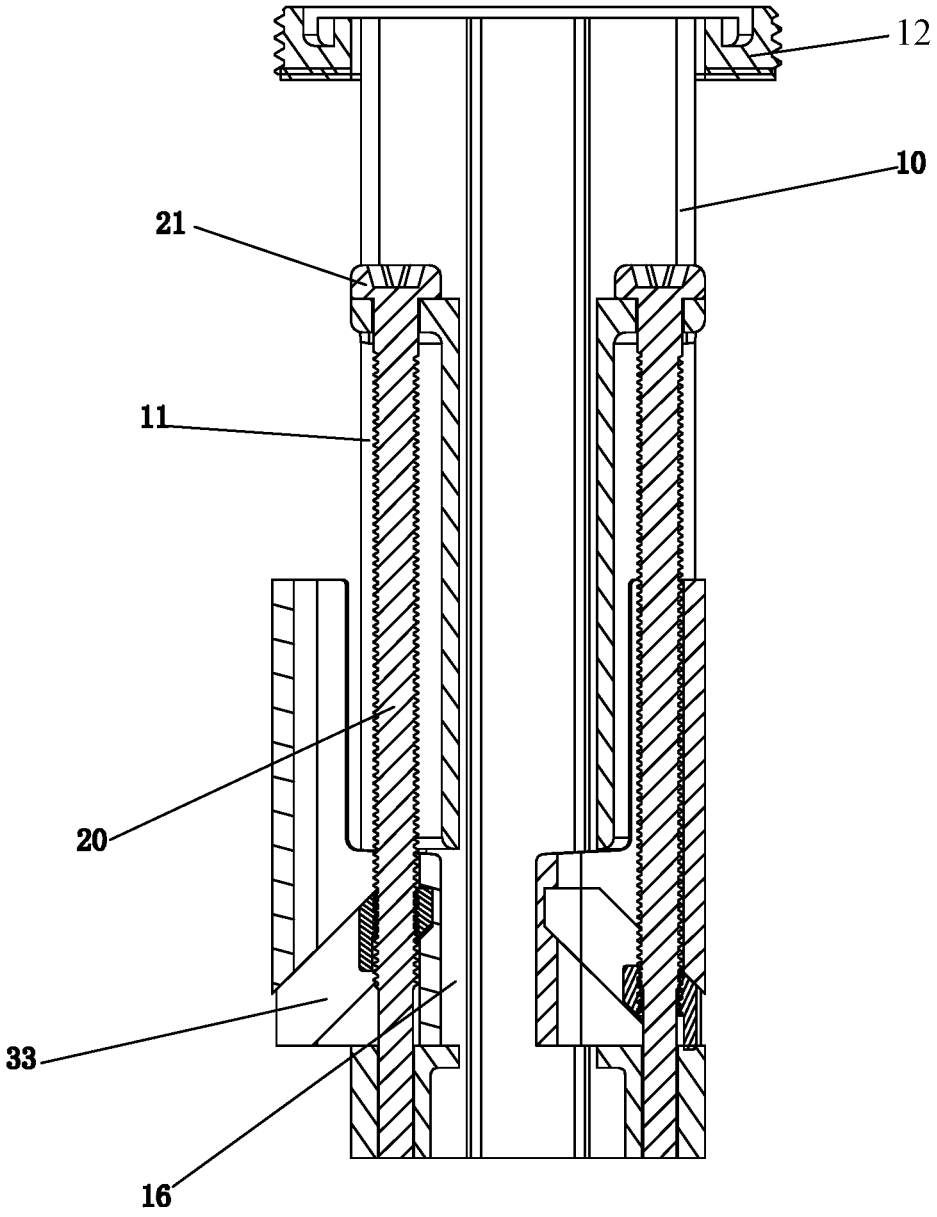
FIG. 5 illustrates a cross-sectional view of the countertop installation assembly of a preferred embodiment in the present disclosure, when the fastening assembly just moves out of the position-providing opening.
Figure 6:
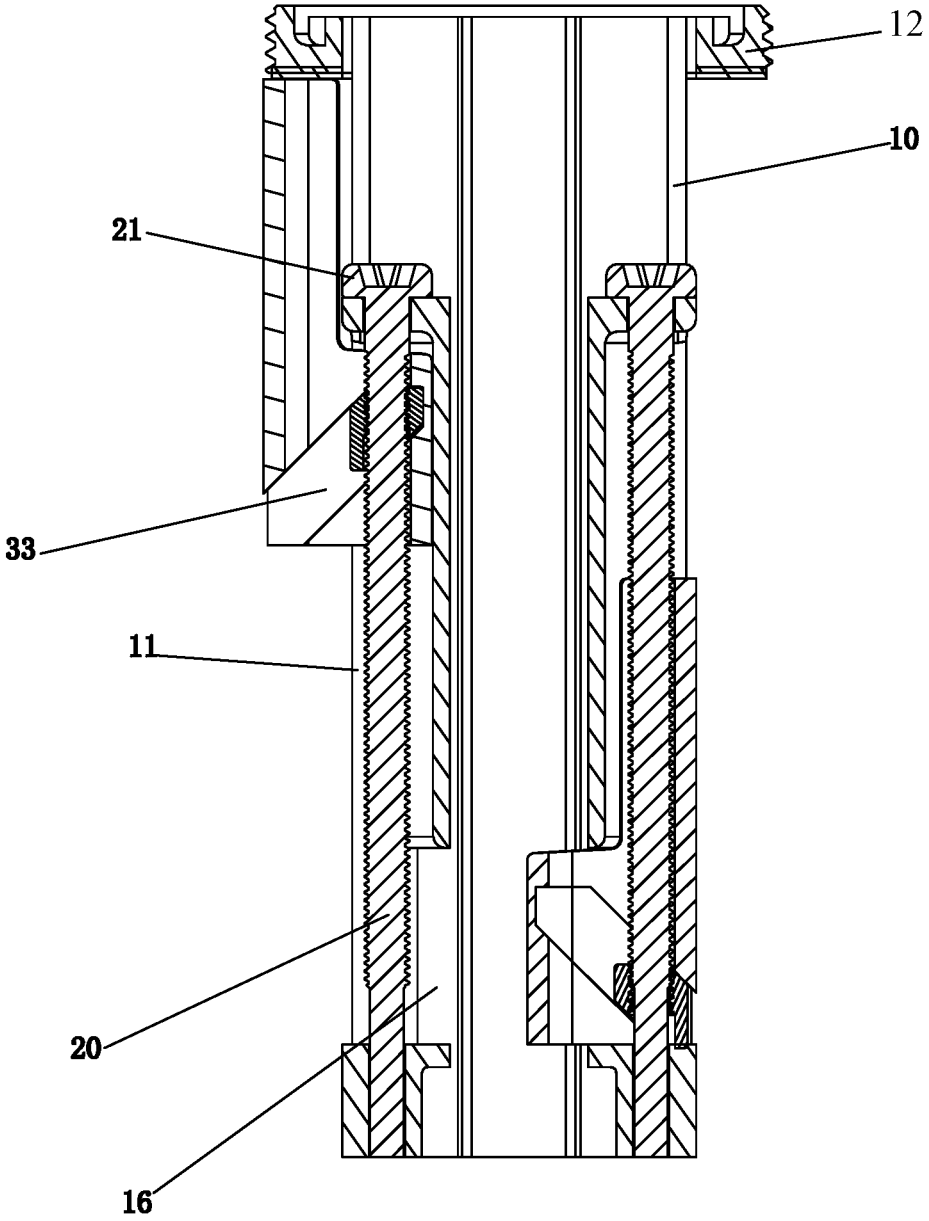
FIG. 6 illustrates a cross-sectional view of the countertop installation assembly of a preferred embodiment in the present disclosure, when the fastening assembly is locked on a countertop.

In this embodiment, referring to FIG. 5, a top end of the inclined cavity 33 is adjacent to a central axis of the installation seat 10, and a bottom end of the inclined cavity 33 is separated from the central axis of the installation seat 10. When the nut 40 is located at the bottom end of the inclined cavity 33, the transverse protruding portion 31 extends into the position-providing opening 16, and the longitudinal protruding portion 32 is located in the receiving cavity 11. When the nut 40 is located at the top end of the inclined cavity 33, the transverse protruding portion 31 moves out of the position-providing opening 16, and the longitudinal protruding portion 32 extends out of the receiving cavity 11.

Preferably, a top end and a bottom end of the nut 40 respectively comprise an inclined surface 41 which cooperates with the inclined cavity 33. The nut 40 is located between the upper through hole 131 and the lower through hole 151.

Referring to FIG. 4, two groups of the fastening assembly and the receiving cavity 11 are provided and are disposed on a left side and a right side of the installation seat 10 in a symmetrical manner. Three or four groups of the fastening assembly and the receiving cavity 11 may be provided as required, but the disclosure is not limited thereto.

The assembly steps of the countertop installation assembly are shown as below.

Firstly, the fastening assembly is adjusted to the initial state. Referring to FIG. 2, the fastening assembly is at a retracted position, the transverse protruding portion 31 extends into the position-providing opening 16, and the transverse protruding portion 31 abuts a top end of the position-providing opening 16, so as to inhibit axial movement of the fastening member 30. The longitudinal protruding portion 32 is located in the receiving cavity 11, and an outer peripheral surface of the longitudinal protruding portion 32 is substantially flush with the outer peripheral surface of the installation seat 10.

Next, the installation seat 10 equipped with the fastening assembly extends into the installation hole from above the countertop until the position-limiting protrusion 12 abuts the top end surface of the installation hole, referring to FIG. 4.

Then, the screwdriver extends into the installation hole from the upper side of the countertop and is matched with the head 21 of the threaded rod 20, and the threaded rod 20 is rotated in a forward direction. The fastening member 30 is continuously moved out of the position-providing opening 16 due to the nut 40 until the transverse protruding portion 31 is completely moved out of the position-providing opening 16. At this time, the fastening assembly is at the extended position, the transverse protruding portion 31 corresponds to the receiving cavity 11, and the longitudinal protruding portion 32 is moved out of the receiving cavity 11 and faces the countertop, referring to FIG. 5.

The threaded rod 20 continues to be rotated in the forward direction, and the transverse protruding portion 31 is separated from inhibition of movement by the position-providing opening 16. The fastening member 30 can be moved up along the threaded rod 20 by the nut 40 until the top end of the longitudinal protruding portion 32 is locked on the lower side of countertop.

The assembly steps of the countertop installation assembly being installed on the countertop are complete. The whole assembly process is completed above the countertop, and operations below the countertop are not needed. The whole assembly process only rotating the threaded rod 20. Complex assembly steps and the like are omitted, the installation time is greatly saved, the installation cost is reduced, and time and labor are saved.

When the countertop installation assembly needs to be disassembled, the threaded rod 20 is rotated in a reversing direction by the screwdriver, and the top end of the longitudinal protruding portion 32 continues to move downward along the receiving cavity 11 after leaving the countertop until the transverse protruding portion 31 abuts the bottom end of the receiving cavity 11. At this time, the transverse protruding portion 31 corresponds to the position-providing opening 16. The threaded rod 20 continues to be rotated in the reversing direction, the transverse protruding portion 31 extends into the position-providing opening 16, and the longitudinal protruding portion 32 moves into the receiving cavity 11. At this time, the initial state of the fastening assembly shown in FIG. 4 is returned, the countertop installation assembly can be taken out from above the installation hole, and the disassembling process is completed.

Figure 7:
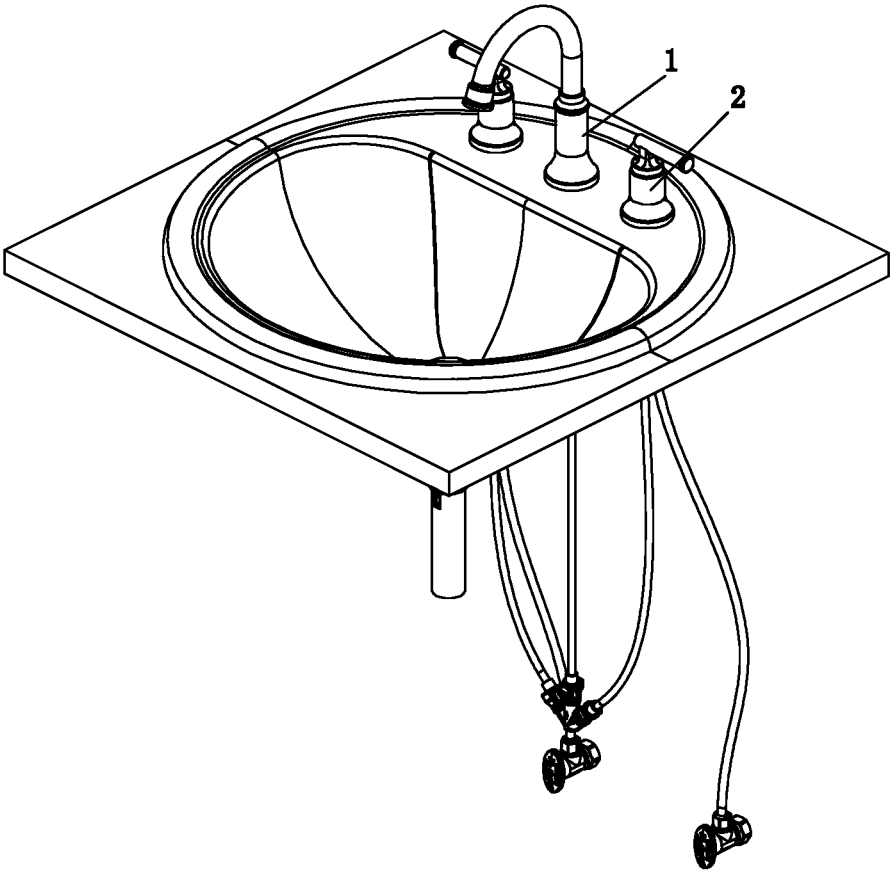
FIG. 7 illustrates a first perspective view of a faucet of a preferred embodiment in the present disclosure.
Figure 8:
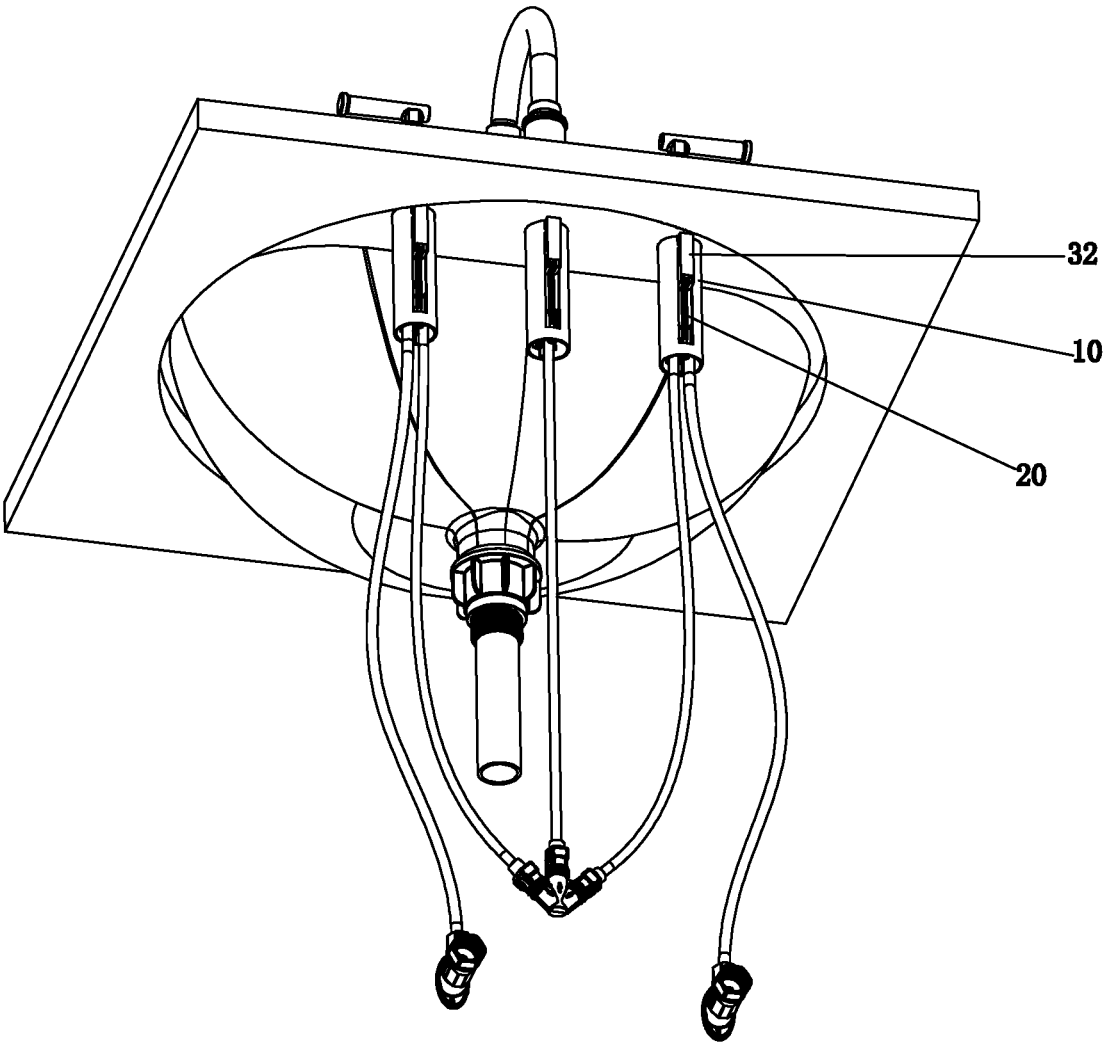
FIG. 8 illustrates a second perspective view of the faucet of a preferred embodiment in the present disclosure.

Referring to FIGS. 7 and 8, an embodiment of a faucet is shown that comprises the above-described countertop installation assembly.

The faucet comprises a faucet body 1 and two valves 2. The faucet body 1 is located between the two valves 2, and the faucet body 1 and the two valves 2 are assembled with a counter basin through the countertop installation assembly.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A countertop installation assembly, configured for being installed on a countertop having an installation hole, comprising:

an installation seat, a driving member, and a fastening assembly, wherein:

the installation seat is configured to be positioned in the installation hole and is configured to extend to below the countertop, the installation seat comprises a receiving cavity extending along a longitudinal direction of the installation seat, the driving member is rotatably disposed in the installation seat, the fastening assembly is operatively coupled to the driving member, the fastening assembly is located below the countertop and is configured to move up and down in the receiving cavity, the driving member is configured to be rotated from above the countertop to drive the fastening assembly to move up and down in the receiving cavity so as to enable the fastening assembly to be clamped to or separated from a lower side of the countertop, a side wall of the receiving cavity comprises a position-providing opening, the fastening assembly is driven by the driving member to be configured to move between a retracted position and an extended position, when the fastening assembly is at the retracted position:

the fastening assembly extends into the position-providing opening, and an outer side surface of the fastening assembly is substantially aligned with an outer peripheral surface of the installation seat, and when the fastening assembly is at the extended position:

the fastening assembly is moved out of the position-providing opening, the outer side surface of the fastening assembly extends out of the outer peripheral surface of the installation seat, and the fastening assembly is movable along the receiving cavity.

2. The countertop installation assembly according to claim 1, wherein:

the driving member is a threaded rod, the threaded rod passes through the receiving cavity along the longitudinal direction of the installation seat and is configured to rotate relative to the receiving cavity, the fastening assembly comprises a fastening member and a nut, the fastening member comprises a transverse protruding portion configured to move into the position-providing opening and a longitudinal protruding portion configured to be clamped to the lower side of the countertop, the transverse protruding portion comprises an inclined cavity, and the nut is screwed on the threaded rod and is located in the inclined cavity.

3. The countertop installation assembly according to claim 2, wherein:

a top end of the inclined cavity is adjacent to a central axis of the installation seat, a bottom end of the inclined cavity is separated from the central axis of the installation seat, when the nut is located at the bottom end of the inclined cavity:

the transverse protruding portion extends into the position-providing opening, and the longitudinal protruding portion is located in the receiving cavity, and when the nut is located at the top end of the inclined cavity:

the transverse protruding portion moves out of the position-providing opening, and the longitudinal protruding portion extends out of the receiving cavity.

4. The countertop installation assembly according to claim 2, wherein:

a top end and a bottom end of the nut respectively comprise an inclined surface configured to cooperate with the inclined cavity.

5. The countertop installation assembly according to claim 2, wherein:

an inside of the installation seat comprises an upper transverse partition, a longitudinal partition, and a lower transverse partition, the upper transverse partition, the longitudinal partition, and the lower transverse partition are connected together in sequence to define the receiving cavity, the upper transverse partition comprises an upper through hole, the lower transverse partition comprises a lower through hole, a top end of the threaded rod comprises a head that abuts the upper transverse partition, a bottom end of the threaded rod passes through the upper through hole and the lower through hole in sequence, and the nut is located between the upper through hole and the lower through hole.

6. The countertop installation assembly according to claim 1, wherein:

a top end of the installation seat comprises a position-limiting protrusion, and the position-limiting protrusion is configured to abut a top end surface of the installation hole.

7. A faucet, comprising:

a countertop installation assembly according to claim 1.

* * * * *